US011198157B2

(12) United States Patent
Mdlazi

(10) Patent No.: US 11,198,157 B2
(45) Date of Patent: Dec. 14, 2021

(54) MINERALS PROCESSING

(71) Applicant: Weir Minerals Africa (Proprietary) Limited, Alberton (ZA)

(72) Inventor: Lungile Mdlazi, Kosmosdal (ZA)

(73) Assignee: Weir Minerals Africa (Proprietary) Limited

( * ) Notice: Subject to any disclaimer, the term of this patent is extended or adjusted under 35 U.S.C. 154(b) by 0 days.

(21) Appl. No.: 16/979,501

(22) PCT Filed: Mar. 11, 2019

(86) PCT No.: PCT/IB2019/051958
§ 371 (c)(1),
(2) Date: Sep. 9, 2020

(87) PCT Pub. No.: WO2019/175746
PCT Pub. Date: Sep. 19, 2019

(65) Prior Publication Data

US 2021/0039139 A1 Feb. 11, 2021

(30) Foreign Application Priority Data

Mar. 13, 2018 (GB) ..... 1803962

(51) Int. Cl.
*B07B 1/42* (2006.01)
*B07B 1/36* (2006.01)

(52) U.S. Cl.
CPC . *B07B 1/42* (2013.01); *B07B 1/36* (2013.01)

(58) Field of Classification Search
CPC .. B07B 1/36; B07B 1/42; B07B 13/16; B07B 13/18; G05B 23/0208; G05B 2219/32182
USPC ..... 209/240, 241, 243, 247
See application file for complete search history.

(56) References Cited

U.S. PATENT DOCUMENTS 3,117,734 A * 1/1964 Mccarty ..... B02C 21/00 241/29
4,627,576 A * 12/1986 Hahn ..... B07B 13/18 241/24.1
4,875,889 A 10/1989 Hagerer et al.
5,074,435 A * 12/1991 Suverkrop ..... B02C 23/02 222/55
5,236,093 A * 8/1993 Marrs ..... B07B 1/15 209/234

(Continued)

FOREIGN PATENT DOCUMENTS

DE 3733619 A1 4/1989

*Primary Examiner* — Joseph C Rodriguez
(74) *Attorney, Agent, or Firm* — Morriss O'Bryant Compagni Cannon, PLLC.

(57) ABSTRACT

A minerals processing unit, such as a vibrating screen (10), is described. The vibrating screen (10) comprises a sensing mechanism operable to detect: (i) motion of the vibrating screen (10) in multiple directions, and (ii) detect planar deviations of a mesh surface (22). The sensing mechanism may comprise a plurality of discrete sensors (60-66), including a gyroscopic sensor (60) operable to detect linear movement in three mutually orthogonal directions, and one or more of roll, pitch, and yaw. The sensing mechanism may further comprise a temperature sensor (64*a*, 64*b*) for measuring the temperature of a drive mechanism (42) and an ambient temperature sensor (66*a*, 66*b*) for measuring a control value to compare with the drive mechanism temperature.

9 Claims, 2 Drawing Sheets

(56) References Cited

U.S. PATENT DOCUMENTS

| | | | | |
|---|---|---|---|---|
| 5,431,287 | A * | 7/1995 | Knox | B07B 1/55 209/250 |
| 6,259,222 | B1 * | 7/2001 | Kira | B02C 25/00 241/35 |
| 6,343,234 | B1 * | 1/2002 | Thomas | B07B 11/04 700/28 |
| 7,938,272 | B2 * | 5/2011 | Antila | B07B 1/005 209/247 |
| 8,746,459 | B2 * | 6/2014 | Scott | B01D 33/76 209/555 |
| 9,475,095 | B2 * | 10/2016 | Jones | B07B 1/284 |
| 10,577,912 | B2 * | 3/2020 | Torrione | E21B 21/065 |
| 2010/0235002 | A1 | 9/2010 | Dufilho et al. | |
| 2011/0285541 | A1 | 11/2011 | Freissle et al. | |
| 2016/0341629 | A1 | 11/2016 | Schaefer | |

* cited by examiner

MINERALS PROCESSING

The present invention relates to minerals processing, for example, minerals separation using a vibrating screen. In particular, although not exclusively, the present invention relates to a linear motion vibrating screen, such as those used in the minerals processing industry.

Vibrating screens are used in the minerals industry for a variety of purposes, including: classification (in which material is separated based on its size); dewatering (which involves removal of process water from the ore); heavy media recovery (which involves draining and rinsing to recover the media) and medium recovery for reuse in the process (e.g. ferro silicon or magnetite); scalping (removing coarse material during primary and secondary crushing); trash removal (screening of grit, wood and oversize material); grading (preparing products with size ranges); desliming (e.g. removal of material smaller than 500 μm).

Vibrating screens are typically fed from a conveyor belt or a hopper, and the loading applied to a vibrating screen where the material enters the screen may not be uniform. This gives rise to unbalanced screen loading and torsion effects that can reduce the life of the vibrating screen, particularly the mesh portions.

It is among the objects of an embodiment of the present invention to obviate or mitigate the above disadvantage or other disadvantages of the prior art.

The various aspects detailed hereinafter are independent of each other, except where stated otherwise. Any claim corresponding to one aspect should not be construed as incorporating any element or feature of the other aspects unless explicitly stated in that claim.

According to an embodiment, a vibrating screen is provided comprising a sensing mechanism operable to detect motion of the vibrating screen in multiple directions and also to detect planar deviations.

According to a first aspect, a vibrating screen is provided comprising a sensing mechanism operable to detect: (i) motion of the vibrating screen in multiple directions comprising linear movement in three mutually orthogonal directions, and (ii) planar deviations of a mesh surface comprising roll and pitch; whereby the sensing mechanism is operable to detect uneven loading of the mesh surface.

The sensing mechanism may comprise an inclinometer or a gyroscope. An inclinometer typically measures roll and pitch, but not yaw; whereas, a gyroscope typically measures yaw in addition to roll and pitch. The three mutually orthogonal directions may comprise x, y, and z directions.

The planar deviations may comprise roll, pitch, and yaw.

The sensing mechanism may further comprise a temperature sensor for measuring the temperature of a drive mechanism (or each drive component within the drive mechanism) and an ambient temperature sensor (for measuring a control value to compare with the drive mechanism temperature). A plurality of ambient temperature sensors may be used.

The sensing mechanism may comprise a gyroscopic sensor. A suitable gyroscope sensor is the LSM330DL linear sensor module 3D accelerometer sensor and 3D gyroscope sensor available from STMicroelectronics (http://www.st-.com/content/st[underscore]com/en.html).

The sensing mechanism may further comprise one or more temperature sensors, one or more accelerometers, one or more vibration sensors, and one or more inclinometers. Suitable solid state inclinometers are available from Kar-Tech (http://kar-tech.com/solid-state-inclinometer.html). Suitable sensors (accelerometers, inclinometers, vibration sensors, and the like) are also available from SignalQuest, LLC (https://signalquest.com/product/rugged-package/sq-rps/), SignalQuest, LLC, 10 Water Street, Lebanon, N.H. 03766 USA.

The vibrating screen may include a bridge extending between opposing sidewalls. The bridge may house, or otherwise support, a drive mechanism that imparts motion to a deck (or multiple decks) of the screen. The mesh surface may be mounted on the (or each) deck.

The sensors may be embedded in the vibrating screen. For example, the sensors may be mounted in a recess defined by a non-wear part of the vibrating screen. The recess may be closed by a removable cover. Embedding the sensors in the vibrating screen has the advantage of shielding the sensors from physical contact by aggregate, rocks, liquid, or the like. Embedding the sensors may also provide electromagnetic shielding for the sensors.

Non-wear parts may include decks, sidewalls, the bridge and the like. Wear parts may include a mesh surface mounted on a deck.

According to a second aspect a vibrating screen monitoring system is provided, the system comprising: a vibrating screen according to the first aspect and further comprising a monitoring computer in communication with the sensing mechanism and operable to pre-process received signals from the sensing mechanism and to provide an indication of how efficiently the vibrating screen is performing by comparing the pre-processed signals with stored signals.

The stored signals may comprise historic baseline signals.

The monitoring computer may also provide an indication of the state of health of the vibrating screen.

The stored signals may comprise baseline reference signals, for example, a historic base trend.

The vibrating screen monitoring system may be in communication with (for example, by providing feedback to) a screen feeding mechanism that feeds material into the vibrating screen and may be used to provide active feedback to the screen feeding mechanism to deflect the feed material to a different portion of the vibrating screen to optimise screen bed depth and minimise planar deviations measured by the sensing mechanism. This enables the incoming feed to be more evenly distributed.

The monitoring computer may provide pre-processing using an algorithm that quantifies the vibrating screen performance (Stroke (mm), frequency (Hz/rpm), excitation (g) and Exciter Health based on bearing/gearbox temperature and excitation deviation between opposing sides of one exciter, or between any two of a plurality of exciters (where multiple exciters are used). Suitable algorithms are available from Merlin CSI LLC of 13135 Danielson Street Suite 212, Poway, Calif. 92064, USA (http://www.merlincsi.com/).

The sensing mechanism may measure temperature (ambient and inside components, such as the exciter gear box or oil sump), excitation frequency, exciter force, and the like.

According to a third aspect there is provided a vibrating screen comprising:

a chassis including opposed sidewalls (side panels) and a bridge extending between the opposed sidewalls;

a mesh surface defining apertures therein;

a drive mechanism coupled to the chassis to impart vibration thereto; and a vibration sensor operable to transmit positional information including displacement in three orthogonal directions, and at least one of: roll, pitch, and yaw.

The vibration sensor may be mounted in the vicinity of the bridge, for example, near or at the centre of the bridge. The bridge may be located at or near a central region of the assembled screen structure.

The vibration sensor may comprise a six-dimensional gyroscopic measuring displacement in three orthogonal directions, roll, pitch, and yaw.

The vibrating screen may further comprise an accelerometer.

The vibrating screen may further comprise a single or multiple decks supporting the mesh surface.

The opposed sidewalls may further comprise a plurality of rubber dampers or coil springs operable to couple to a support external to the vibrating screen so that the vibrating screen oscillates.

The opposed sidewalls may further comprise elastomer lining on an inner surface of each sidewall to reduce wear of the sidewalls.

The accelerometer may comprise a uniaxial accelerometer.

The dampers may comprise coil springs, solid elastomer shapes, or the like.

The vibrating screen may comprise a linear motion vibrating screen. Alternatively, the vibrating screen may comprise a circular motion vibrating screen or an elliptical motion vibrating screen.

The drive mechanism may comprise an exciter. Optionally, an exciter pair may be provided, each exciter in the exciter pair including a gearbox coupled on each side to an out-of-balance mass, where the gearbox rotates the out-of-balance masses in opposite directions (i.e. the out-of-balance masses being contra-rotated by the exciters).

Alternatively, the drive mechanism may comprise an out-of-balance motor.

According to a fourth aspect there is provided a method of detecting deviation from standard performance of a vibrating screen, the method comprising:

using a drive mechanism to impart vibration to a chassis of the vibrating screen;

using a sensing mechanism to capture positional information of the chassis, including vibration in three orthogonal linear directions, and at least one of: roll, pitch, and yaw;

using an accelerometer to detect vibrational information relating to the chassis; and transmitting the positional information and the vibrational information to a signal processor to enable a monitoring system to detect deviation from standard performance of the vibrating screen based on the transmitted positional and vibrational information.

According to a fifth aspect there is provided a method of correcting deviation from standard performance of a vibrating screen, the method comprising the steps of the fourth aspect and the further steps of:

calculating how material from a vibrating screen feeder should be re-directed to reduce any planar deviations and restore standard performance of the vibrating screen; and transmitting to the feeder a deflection signal to deflect the feeder so that the material is re-directed as calculated in the preceding step.

The sensors may transmit information in a wired or wireless manner.

According to a sixth aspect there is provided a management system for a minerals process, the system comprising:

a minerals processing unit;

a plurality of sensors mounted thereon;

a data management unit in communication with the sensors;

an analytics system for analysing the output of the sensors to detect abnormal operation of the minerals processing unit.

The minerals processing unit may comprise comminution equipment such as, a vibrating screen, a cone crusher unit, a ball mill unit, a cyclone (gas or hydro), a vibrating feeder, or the like.

The comminution equipment may comprise a separation unit such as a vibrating screen or a cyclone (gas or hydro).

The system may further comprise: a video camera system.

The video camera system may be mounted above the vibrating screen and directed towards a material conveyor that feeds material into the vibrating screen for separation therein.

The sensors may include any of the sensors described with respect to the first to fifth aspects.

According to a seventh aspect there is provided a vibrating screen comprising a sensing mechanism including a gyroscope sensor operable to measure positional information including displacement in three orthogonal directions comprising roll, pitch, and yaw, the sensing mechanism being operable to detect: (i) motion of the vibrating screen in multiple directions comprising linear movement in three mutually orthogonal directions, and (ii) planar deviations of a mesh surface comprising roll, pitch, and yaw; whereby the sensing mechanism is operable to detect uneven loading of the mesh surface.

By virtue of one or more of these aspects, a simple system is provided that enables a minerals processing unit, such as a vibrating screen, to be monitored.

Certain aspects allow the loading on a vibrating screen to be calculated, thereby ascertaining how well the vibrating screen is performing. By using a multi-dimensional sensor fewer sensors would be required, thereby enabling a monitoring computer to monitoring multiple vibrating screens simultaneously.

These and other aspects will be apparent from the following specific description, given by way of example only, with reference to the accompanying drawings, in which.

Figure 1:
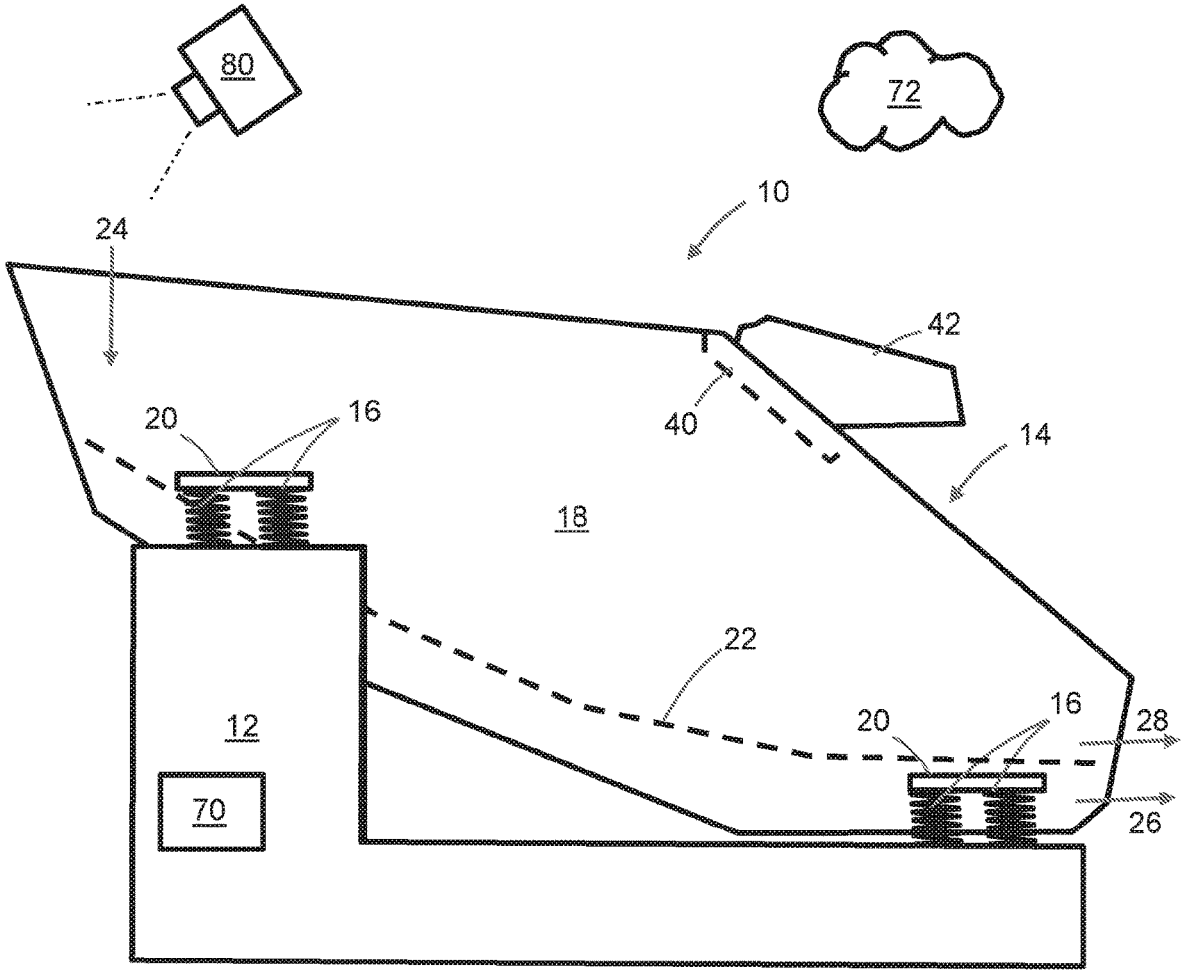
FIG. 1 is a schematic diagram of a vibrating screen according to a first embodiment of the present invention.

Reference is first made to FIG. 1, which is a linear, multi-slope, vibrating screen 10 according to a first embodiment of the present invention, mounted on an external support 12.

The vibrating screen 10 comprises a chassis (shown generally as 14) mounted to the external supports 12 by a plurality of dampers 16 in the form of sets of coil springs or rubber buffers. The chassis 14 comprises a pair of spaced generally parallel sidewalls 18 (only one of which is visible in FIG. 1). The dampers 16 are mounted on plates (suspension brackets) 20 secured to each sidewall 18.

A mesh surface 22 (shown in broken line in FIG. 1) is mounted on a deck support (not shown) extending between the opposing sidewalls 18. The mesh surface 22 (also referred to as a graded panel) receives material (such as aggregate, rocks, gravel, slurry, a mineral solution, or the like) via feed area (shown generally by arrow 24) and allows particles smaller than the apertures in the mesh (or liquids) to fall therethrough and be transported to a small particle (or liquid) discharge area (shown generally by arrow 26); whereas larger particles remain on top of the mesh surface 22 and exit from the vibrating screen at large particle discharge area (shown generally by arrow 28).

The mesh surface 22 and deck support (not shown) define a plurality of slope portions. The first slope portion defining a slope of approximately 45 degrees to the horizontal in the vicinity of the feed area 24, successive slope portions defining successively smaller slopes, and the final slope portion having a zero degrees (or nearly zero degrees) slope at the discharge areas 26,28. This type of multi-sloped vibrating screen is typically referred to as a banana screen.

Figure 2:
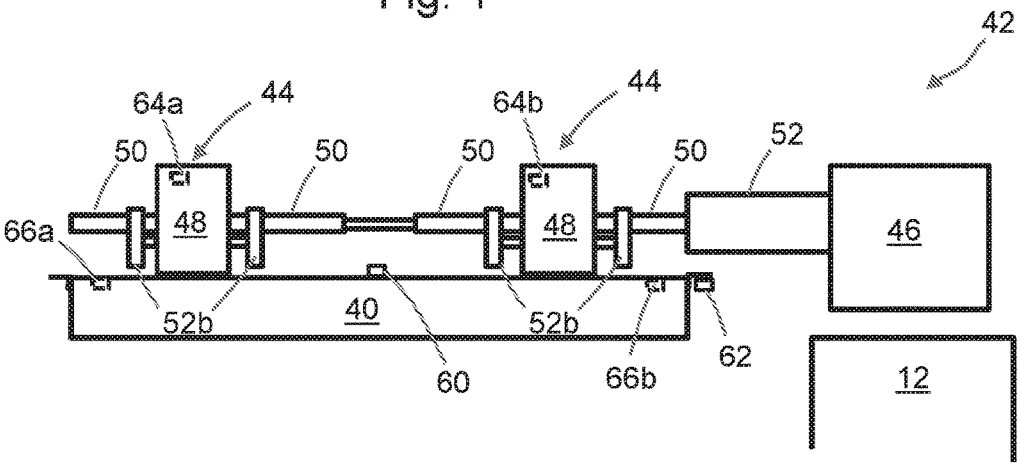
FIG. 2 is a schematic diagram of parts (the bridge, exciter, and motor) of the vibrating screen of FIG. 1.
Figure 3:
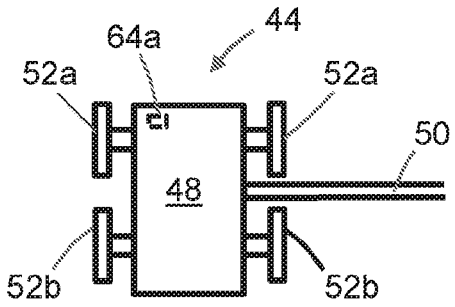
FIG. 3 is a schematic diagram of a part (the exciter) shown in FIG. 2.

At a central portion of the opposed sidewalls 18, and extending therebetween, is a bridge 40 (best seen in FIG. 2). The bridge 40 comprises a flat mounting surface oriented at an angle to the horizontal, typically between 40 degrees and 60 degrees. Mounted on the bridge 40 is a drive mechanism 42.

The drive mechanism 42 may take a number of different forms. In this embodiment, the drive mechanism 42 takes the form of a pair of identical exciters 44 (best seen in FIG. 2) powered by a motor 46. The motor 46 may be mounted on the bridge 40 or to one side of the bridge 40 on the external supports 12 (as shown in FIG. 2).

Each exciter 44 comprises a gearbox 48 having a pair of output shafts 50 extending therethrough and protruding out each side of the gearbox 48. On each side of each gearbox 44 is mounted a pair of out-of-balance masses 52*a,b* in the form of weighted segments. Each gearbox 48 receives relatively fast rotational input from the motor 46 via a drive shaft 50 coupled to the motor 46 by a universal coupling shaft (or Cardan shaft) 54. Each gearbox 48 converts the high speed rotation of drive shaft 50 to low speed, high torque rotation of the output shafts 50, and via those shafts 50 the weighted segments.

Each gearbox 48 rotates the output shafts 50 in opposite directions, which in turn rotate each pair of weighted segments 52*a,b* in opposite directions (i.e. weighted segment 52*a* is rotated in an opposite direction to weighted segment 52*b*). The combined movement of these weighted segments 52*a,b* is what imparts oscillation to the chassis 14. In particular, the excitation generates linear acceleration forces which are transmitted via the bridge 40 and opposed sidewalls 18 to the chassis 14 as a whole and thus also to the mesh surface 22 and the material deposited on that surface 22. Not only are the forces large, (typically acceleration of 5 g is required in mineral processing applications), but they are also cyclic at a frequency typically in the range 30 of 14 Hz to 25 Hz. These forces give rise to bending of the bridge 40 itself which in turn induces bending and buckling of the opposed sidewalls 18 and potentially the mesh surface 22 itself. It is desirable to detect when such bending or buckling of the mesh surface 22 occurs, which in this embodiment is implemented using sensors mounted on the vibrating screen 10, as will now be described.

A suitable vibrating screen having the features described above is available from The Weir Group PLC (www.global-.weir), for example, the Enduron (trade mark) Single Deck Banana vibrating screen. This type of screen can be modified by adding the components that will now be described.

A 6 dimensional gyroscope sensor 60 such as the LSM330DL Linear sensor module 3D accelerometer sensor and 3D gyroscope sensor available from STMicroelectronics (http://www.st.com/content/st_com/en.html) is mounted at a central region of the bridge 40. In this embodiment, the gyroscope sensor 60 is mounted directly on the centre of the bridge 40 in a recessed portion thereof, which is removably sealed by an elastomer or plastic cover to prevent ingress of aggregate or water to the gyroscope sensor 60, and also to prevent aggregate or other material from striking the gyroscope sensor 60, thereby embedding the gyroscope sensor 60 in the bridge 40.

The gyroscope sensor 60 is operable to measure positional information including displacement in three orthogonal directions, roll, pitch, and yaw. The displacement, roll, pitch, and yaw of the bridge 40 corresponds to the displacement, roll, pitch, and yaw of the mesh surface 22, so this gyroscope sensor 60 provides an indirect measurement of any twisting of the mesh surface 22.

A uniaxial accelerometer 62 is mounted on the chassis 12, in this embodiment on one side of the bridge 40 on a recess in a downward facing surface to protect the accelerometer 62 from being struck by aggregate or other material or objects (although the specific location of this accelerometer 62 is not critical). This embeds the gyroscope sensor 60 in the bridge 40. In this embodiment, the accelerometer is an industrial uniaxial accelerometer available from Industrial Monitoring Instrumentation, 3425 Walden Avenue, Depew, N.Y. 14043-2495 USA (www.imi-sensors.com). The uniaxial accelerometer 62 provides a measure of the vibration of the chassis 14 and its various parts (including the mesh surface 22).

A pair of temperature sensors 64*a*,64*b* are mounted on the exciters 44; one temperature sensor 64 in each gearbox 48 to measure the temperature of the oil (or other lubricant/coolant) in that gearbox 48.

A pair of ambient temperature sensors 66*a*,66*b* are mounted on the vibrating screen 10 (the specific location is not very important) to provide an indication of the ambient temperature in which the vibrating screen 10 is operating. This can be subtracted from the readings from the exciter temperature sensors 64*a,b* (or otherwise used to normalise those readings).

A data management unit 70 (FIG. 1) is mounted on the external supports 12 (or any other convenient location) and receives transmitted signals from each of the sensors 60 to 66. The signals may be transmitted using wired connectors or in a wireless manner.

The data management unit 70 pre-processes the data to make it easier to analyse, and then transmits the pre-processed data to a cloud-based analytics system 72 for analysis. The pre-processing includes, but is not limited to, double integration of the vibration signal from the gyroscopic sensor 60 to obtain the displacement (screen stroke), conducting Fast Fourier Transform (FFT) processing on the raw vibration data from the gyroscopic sensor 60 to obtain the screen frequency in Hz and calculating the root mean square (RMS) and running averages of features and metrics. In this embodiment the data management unit 70 is based on the SINET (trade mark) product range provided by Merlin CSI LLC, and the cloud-based analytics system 72 is based on the Microsoft (trade mark) Azure (trade mark) platform and algorithms provided therein.

Figure 4:
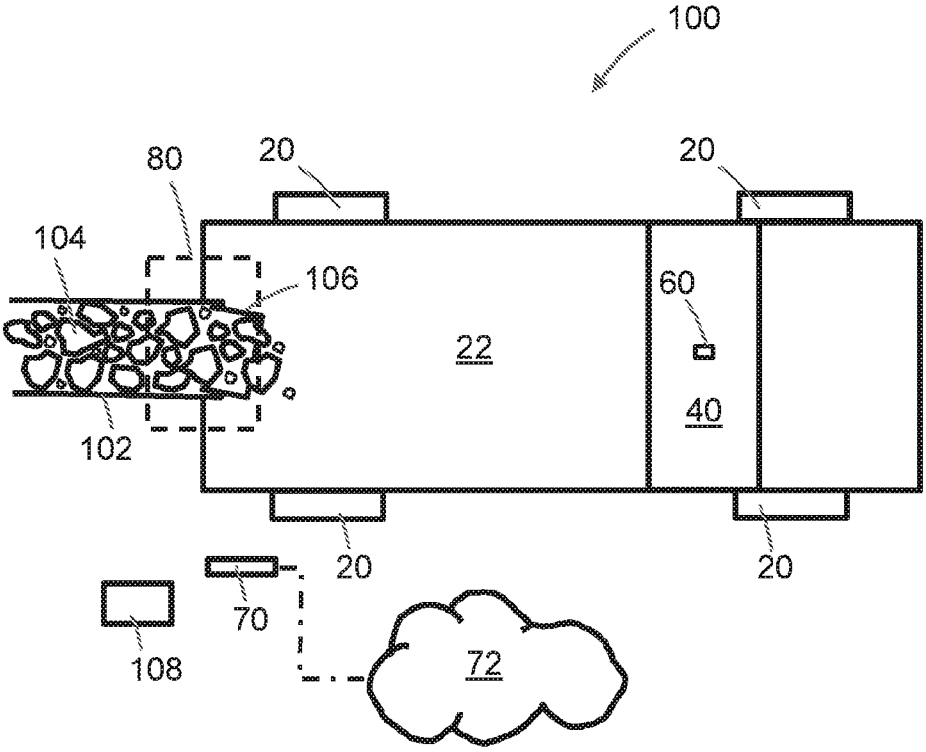
FIG. 4 is a schematic diagram of a minerals processing management system including the vibrating screen of FIG. 1

Reference is now made to FIG. 4, which is a schematic diagram of a vibrating screen management system 100.

The vibrating screen management system 100 comprises the vibrating screen 10, the data management unit 70, the cloud-based analytics system 72 for analysis of the output of the sensors 60 to 66, a video camera system 80 (best seen in FIG. 1; shown as a broken line in FIG. 4 to prevent parts being obscured) mounted above the vibrating screen 10 and directed towards a material conveyor 102 that feeds material 104 (which in this embodiment is aggregate of various sizes) into the vibrating screen for separation therein. The material conveyor 102 includes a deflectable snout 106 (also referred to as a vibrating screen feeder) that can be moved by a controller 108 in response to a signal received from the analytics system 72. The controller 108 controls operation of the vibrating screen 10 and the conveyor 102 (and potentially other plant operating at the site). The deflectable snout 106 may be pivotably coupled at the end of the conveyor 102 so that by moving the deflectable snout 106 aggregate can be fed into a different portion of the feed area 24.

The video camera system 80 includes a processor programmed with a conventional automated machine vision algorithm that detects the profile of aggregate approaching the snout 106. This enables the video camera system 80 to detect potential uneven loading of the mesh surface 22 prior to the aggregate 104 being fed from the conveyor 102 into the vibrating screen 10. The video camera system 80 may also view the feed area 24 to ascertain if there is uneven loading of the feed area 24. The video camera system 80 transmits a loading parameter to the cloud-based analytics system 72 (either directly or via the data management unit 70) based on the detected or anticipated loading.

The analytics system 72 receives sensor information via the data management unit 70, and processes the information to identify any abnormal operation, or any indications that may indicate potential future abnormal operation. Examples of abnormal operation will now be described.

If there is a fault within the exciters 44, the oil may overheat, which would be detected by the temperature sensor 64 and transmitted via the data management unit 70 to the cloud-based analytics system 72. The cloud-based analytics system 72 analyses the received temperature signal and compares (or correlates) it with the ambient temperature measured by sensors 66. If the exciter temperature 64 exceeds a predefined criterion (which may be one or more of: the absolute temperature, the temperature difference to ambient, the rate of temperature rise, or the like), then the analytics system 72 sends a signal to the controller 108, which can then decrease the speed of the motor 46 or stop the motor 46.

If there is uneven loading of the mesh surface 22 then the gyroscope sensor 60 detects this as a change in the pitch, roll, or yaw (or a combination of these) and transmits a signal via the data management unit 70 to the cloud-based analytics system 72. The cloud-based analytics system 72 can ascertain if the uneven loading is detrimental to performance based on a predefined performance criterion. The analytics system 72 also determines if the uneven loading is a result of an uneven distribution of aggregate 104 from the conveyor 102. If the uneven loading results from the profile of aggregate 104 being fed into the vibration screen 10 then the analytics system 72 sends a signal to the controller 108 indicating how the snout 106 should be moved (deflected) to provide a more even distribution of aggregate 104.

If the vibrating screen 10 is displaced in the x (longitudinal direction of chassis 14), y (width direction of chassis 14), or z (height direction of chassis 14) direction beyond what is defined then this is detected by the gyroscope sensor 60, which transmits a signal via the data management unit 70 to the cloud-based analytics system 72. The cloud-based analytics system 72 can ascertain if the detected displacement is beyond a predefined displacement criterion. If the detected displacement is beyond a predefined displacement criterion then the analytics system 72 sends a signal to the controller 108, which can then decrease the speed of the motor 46 or stop the motor 46.

For any or all of these detected abnormalities, the cloud-based analytics system 72 also provides an indication to a registered operator of the vibrating screen, for example, via a dashboard view on a mobile application presented on a mobile device carried by the registered operator.

In another example, one temperature sensor 64*a* may indicate that one of the exciters 44 is overheating, but another temperature sensor 64*b* may indicate that the other exciter 44 is not overheating (i.e. operating normally). If the gyroscopic sensor 60 or the uniaxial accelerometer 62 indicates that the mesh surface 22 is deflected, twisted, or otherwise unbalanced, then this may be due to the exciter 44 that has the high temperature, not any imbalance in distribution of the material 104 on the mesh surface 22.

It will now be appreciated that the above embodiments have the advantage that a vibrating screen 10 can be monitored and changes to the operation can be made automatically to ensure that the vibrating screen 10 remains operational or operates more effectively. By combining the outputs from different types of sensors, the operation of the vibrating screen 10 can be diagnosed and optimised.

It should also be appreciated that the above embodiment contemplates the optimised use of a six dimensional (or six axis) gyroscope mounted at the centre of the bridge coupled with a uniaxial accelerometer to continuously monitor the health and performance of a vibrating screen. The condition and health of the vibrating screen is quantified using a low sensor count. This minimises any cabling that is required in instances where cables are used to connect the sensors to the data management unit 70, and minimises the number of wireless nodes and channels in instances where wireless data transmission is employed. However, in other embodiments, an inclinometer may be used instead of a gyroscope.

Various modifications may be made to the above embodiments within the scope of the present invention. For example, the vibrating screen may be a horizontal screen rather than a multi-slope screen. The drive mechanism may be a motor having a weight mounted eccentrically thereon. Only a single drive mechanism may be used, rather than having two exciters 44.

The vibrating screen may comprise multiple decks at different heights, each deck supporting a mesh having a different mesh aperture size to those of other deck meshes. Typically, the mesh aperture size is largest for the uppermost deck, and decreases for each deck lower in the stack of decks. This enables the vibrating screen to classify material into multiple different sizes, not just a mixed group of sizes.

In other embodiments, a different processing unit may be monitored by sensors, for example a different separation unit, such as a cyclone (hydro or gas), or a different comminution unit, such as a cone crusher or a ball mill.

A single temperature sensor may be used (instead of two temperature sensors) or more than two temperature sensors may be used.

The aggregate conveyed to the feed area may be a fluid (such as a liquid solution) rather than a solid.

In other embodiments, additional sensors may be used. For example, a pressure sensor may be located in the exciters 44 to indicate the oil pressure (or the pressure of any other lubricant or coolant). This may indicate an oil leak or other failure mode within the exciter 44.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

The invention claimed is:

1. A vibrating screen monitoring system comprising:

(a) a vibrating screen including a feed area;

(b) a sensing mechanism operable to detect:

(i) motion of the vibrating screen in multiple directions comprising linear movement in three mutually orthogonal directions, and (ii) planar deviations of a mesh surface comprising roll and pitch;

whereby the sensing mechanism is operable to detect uneven loading of the mesh surface; and (c) a monitoring computer in communication with the sensing mechanism and operable to:

(i) pre-process signals received from the sensing mechanism, (ii) compare the pre-processed signals with stored signals to ascertain how effectively the vibrating screen is operating; and (iii) provide an indication of how effectively the vibrating screen is operating; characterised by (d) a feeder that feeds material into the vibrating screen for separation therein, the feeder including a deflectable snout pivotably coupled at the end of the feeder so that by moving the deflectable snout material can be fed into a different portion of the feed area;

(e) a video camera system mounted above the vibrating screen and directed towards the feeder and to view the feed area to ascertain if there is uneven loading of the feed area;

whereby the monitoring system is operable to provide the feeder with a feedback signal to optimize the feed delivery so that a different portion of the vibrating screen receives material to reduce any planar deviations measured by the sensing mechanism.

2. A vibrating screen monitoring system according to claim 1, wherein the sensing mechanism further comprises a plurality of discrete sensors.

3. A vibrating screen monitoring system according to claim 1, wherein a sensor is embedded in a recess in the vibrating screen.

4. A vibrating screen monitoring system according to claim 1, wherein the sensing mechanism comprises an inclinometer or a gyroscope.

5. A vibrating screen monitoring system according to claim 1, wherein the sensing mechanism measures roll, pitch, and yaw of the mesh surface.

6. A vibrating screen monitoring system according to claim 1, wherein the sensing mechanism further comprises a temperature sensor for measuring the temperature of a drive mechanism and an ambient temperature sensor for measuring a control value to compare with the drive mechanism temperature.

7. A vibrating screen monitoring system according to claim 1, wherein the sensing mechanism further comprises an accelerometer.

8. A method of detecting deviation from standard performance of a vibrating screen for minerals processing, the method comprising:

(i) using a drive mechanism to impart vibration to a chassis of the vibrating screen;

(ii) using a sensing mechanism to capture positional information of the chassis, including displacement in three orthogonal linear directions, and at least one of: roll, pitch, and yaw;

(iii) using an accelerometer to detect vibrational information relating to the chassis;

(iv) transmitting the positional information and the vibrational information to a signal processor to enable a monitoring system to detect deviation from standard performance of the vibrating screen based on the transmitted positional and vibrational information; characterised by (v) using a video camera system mounted above the vibrating screen and directed towards a vibrating screen feeder to view a feed area to ascertain if there is uneven loading of the feed area;

(vi) calculating how material from the vibrating screen feeder should be re-directed to reduce any planar deviations and restore standard performance of the vibrating screen;

(vii) transmitting to the feeder a deflection signal to deflect a deflectable snout pivotably coupled at the end of the feeder so that material from the feeder is re-directed as calculated in the preceding step to deposit material into a different portion of the feed area.

9. A vibrating screen monitoring system according to claim 6, wherein the screen further comprises a pair of exciters, a gearbox temperature sensor and an ambient temperature sensor, wherein when the gearbox temperature sensor indicates that one of the exciters is overheating, and the gyroscope sensor indicates that the mesh surface is deflected, twisted, or otherwise unbalanced, then the monitoring system indicates that this may be due to the exciter that has the high temperature, not any imbalance in distribution of the material on the mesh surface.

* * * * *